United States Patent [19]

Noschese

[11] Patent Number: 4,734,057

[45] Date of Patent: Mar. 29, 1988

[54] CONNECTOR ASSEMBLY

[75] Inventor: Rocco Noschese, Wilton, Conn.

[73] Assignee: Burndy Corporation, Norwalk, Conn.

[21] Appl. No.: 20,662

[22] Filed: Mar. 2, 1987

[51] Int. Cl.[4] ..... H01R 13/40

[52] U.S. Cl. ..... 439/589; 439/586

[58] Field of Search ..... 439/271, 275, 278, 279, 439/296, 352, 355, 345, 586, 587, 589, 603

[56] References Cited

U.S. PATENT DOCUMENTS

| | | | |
|---|---|---|---|
| 2,903,668 | 9/1959 | Cornell, Jr. | 339/63 |
| 3,097,036 | 7/1963 | Cornell, Jr. | 339/176 |
| 3,129,814 | 4/1964 | Cheh et al. | 206/56 |
| 3,456,232 | 7/1969 | Dupre | 339/96 |
| 3,840,839 | 10/1974 | Smaczny et al. | 439/589 |
| 3,840,841 | 10/1974 | Clark | 439/589 |
| 4,531,796 | 7/1985 | Gansert et al. | 439/589 |

*Primary Examiner*—Gil Weidenfeld
*Assistant Examiner*—Paula A. Austin
*Attorney, Agent, or Firm*—Perman & Green

[57] ABSTRACT

A connector assembly in which a housing has a plurality of side-by-side mutually isolated bores which extend between an entry aperture in a front wall and an aft end. Each bore contains an elongated contact which has a hollow pin receiving end adjacent the aperture in the front wall and a wire receiving barrel at its opposite end subject to a crimping action for engagement with an associated wire lead. A resilient grommet seal mounted at the aft end of the housing has a plurality of side-by-side openings therein aligned with the bores in the housing for sealingly engaging the wire ends. A dielectric spacer within each bore serves to assure high surface resistivity between contacts positioned in adjacent bores.

16 Claims, 8 Drawing Figures

CONNECTOR ASSEMBLY

BACKGROUND OF THE INVENTION

I. Field of the Invention

The invention herein relates generally to a multiple contact electrical connector assembly and, more particularly, to an improved multiple contact connector assembly enabling high speed manufacturing techniques, self sealed against moisture and dirt penetration during and after manufacture, and assuring electrical isolation of neighboring contacts.

II. Description of the Prior Art

There is an ever increasing requirement in a host of applications for a multiple contact electrical connector which can be readily and easily assembled from a minimum of parts, which can be readily joined to a plurality of wire leads, which is so constructed as to provide self sealing against the intrusion of moisture and debris during and after assembly, and which assures electrical isolation between adjacent contacts. A particularly important use for connectors having these features is in modern aircraft which possess sophisticated, complex control and operating electronic components and systems.

Typical of known multiple contact connectors which have been effective in providing protection against moisture and contamination are commonly assigned U.S. Pat. No. 2,903,668 issued Sept. 8, 1959 to E. S. Cornell, Jr., entitled "Multiple Connector" and U.S. Pat. No. 3,456,232 issued July 15, 1969 to H. P. Dupre, entitled "Self-Sealing Connector". Although these connectors represented the state of the art when they were introduced, they no longer satisfy the demands of modern sophisticated systems. For example, they are not suited to the high speed assembly operations which are presently sought after, nor are they concerned with crimping operations which have been simplified by reason of the present invention.

In more recent times, there have been moderately successful attempts to design a modular connector assembly having multiple contacts in side by side relationship which lends itself to high speed assembly operations and which also effectively isolates, electrically, adjacent contacts. This has been achieved by various constructions. For example, in one instance, a cylindrical spring retainer is received in its own cylindrical recess formed in a main housing of the connector aligned with an elongated contact-receiving bore. Thereupon a back housing, similarly bored as the main housing, is applied to the main housing, the structure held together by a metal shell. The spring retainer is thus captured in place within the housing such that when a contact is inserted into the bore, the retainer is effective to engage the spring and prevent its subsequent withdrawal. In another instance, the spring retainer has been held in position by being bonded to the housing within its own recess with a suitable adhesive. In yet another instance, the housing is of molded one-piece construction. In this instance, each mold pin for forming the bores has a metallic ferrule thereon which defines a recess for the spring retainer which is snapped into place. The recess actually results after the ferrule is etched away with a suitable acid which does not harm the housing.

Connector assemblies manufactured using these techniques have been effective to create long creepage paths and therefore increase electrical resistivity between adjacent contacts. However, they were generally labor intensive or otherwise costly and did not permit high speed assembly.

SUMMARY OF THE INVENTION

It was with knowledge of the prior art as described above that the present invention was conceived and has now been reduced to practice. According to the invention, a connector assembly is disclosed in which a housing has a plurality of side-by-side mutually isolated bores which extend between an entry aperture in a front wall and an aft end. A spring retainer is received in each bore followed by a dielectric spacer. A resilient grommet seal is mounted at the aft end of the housing and has a plurality of side-by-side openings therein aligned with the bores in the housing for sealingly engaging either the contacts or the wire leads extending therefrom. A latch plate overlies a portion of the housing and the grommet seal and by reason of a down turned trailing edge holds the grommet seal, the dielectric spacer, and all of the spring retainers in proper position within the housing.

An elongated contact which has a hollow pin receiving end adjacent the aperture in the front wall is received within each bore, and is prevented from being removed by the spring retainer. Each contact also has a wire receiving barrel at its opposite end subject to a criming action for engagement with an associated wire lead. The dielectric spacer includes structure within each bore which substantially surrounds each contact and serves to assure high surface resistivity between contacts positioned in adjacent bores.

According to one feature of the invention, the connector disclosed lends itself to high speed assembly techniques. Additionally, it utilizes a minimum of parts in its construction which simplifies assembly. A particularly important feature of the invention resides in the provision in the grommet seal which is effective, in one instance, to resiliently but firmly hold the contacts of the connector in a preassembled intermediate position to allow a rapid crimping action which may be performed either sequentially or in gang fashion. In another instance, the grommet seal is effective to prevent entry of moisture and debris into the interior of the connector after the contacts have been moved to their fully assembled positions.

Other and further features, objects, advantages, and benefits of the invention will become apparent from the following description taken in conjunction with the following drawings. It is to be understood that both the foregoing general description and the following detailed description are exemplary and explanatory but not restrictive of the invention. The accompanying drawings which are incorporated in, and constitute a part of the invention, illustrate one embodiment of the invention and, together with the description, serve to explain the principles of the invention in general terms. Like numerals refer to like parts throughout.

DETAILED DESCRIPTION OF THE PREFERRED EMBODIMENT

Figure 1:
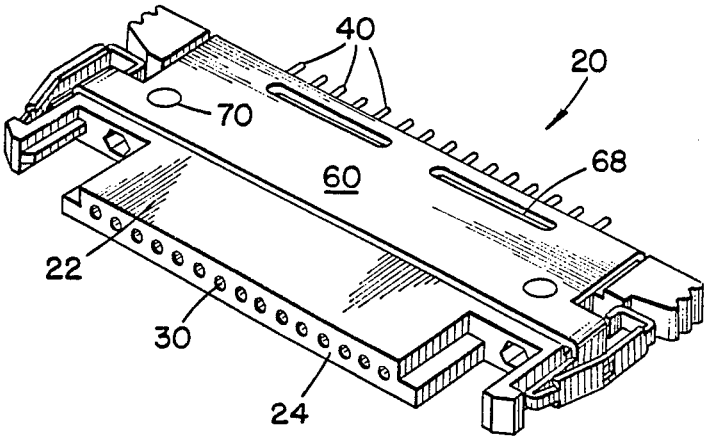
FIG. 1 is a perspective view of an assembled electrical connector embodying the invention, taken generally from its forward end.
Figure 2:
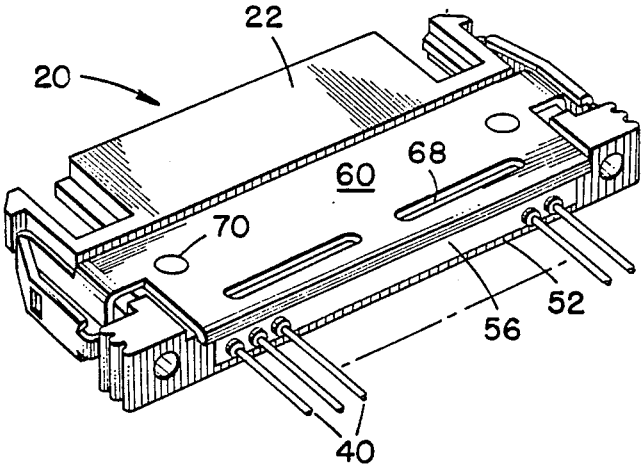
FIG. 2 is a perspective view of the connector of FIG. 1 taken generally from its aft end.
Figure 3:
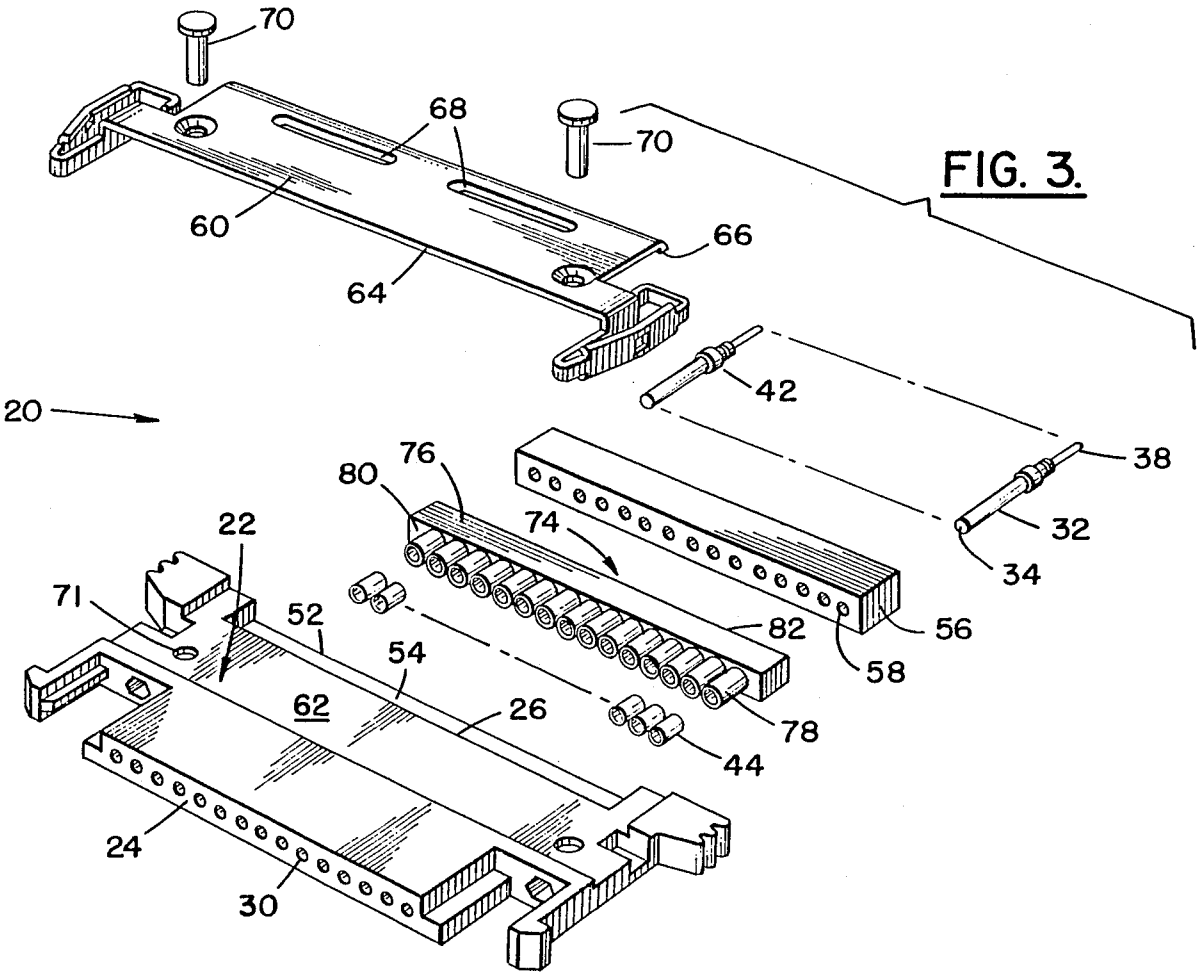
FIG. 3 is an exploded perspective view of the connector illustrated in FIGS. 1 and 2.
Figure 4:
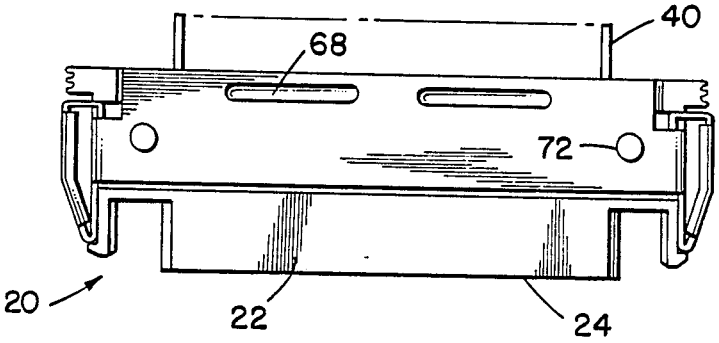
FIGS. 4 and 5 are top plan and front elevation views, respectively, of the connector illustrated in FIGS. 1–3.
Figure 5:
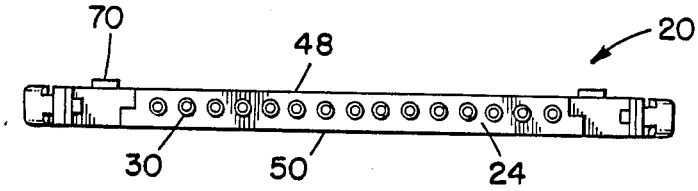

The connector assembly which is the subject of the invention herein will now be described with reference to the accompanying drawings. Turn initially to FIGS. 1–5 which illustrate a connector assembly 20 embodying the present invention.

The connector assembly 20 includes a housing 22 of dielectric material having a front wall 24 and an aft end 26. The housing 22 is provided with a plurality of side-by-side mutually isolated bores 28 (see FIGS. 6–8) which extend between the front wall 24 and the aft end 26 and terminate at an entry aperture 30 formed in the front wall 24. The bores 28 are of varying diameters as they extend from the front wall 24 to the aft end 26 so as to accommodate different components which will be described subsequently.

Figure 7:
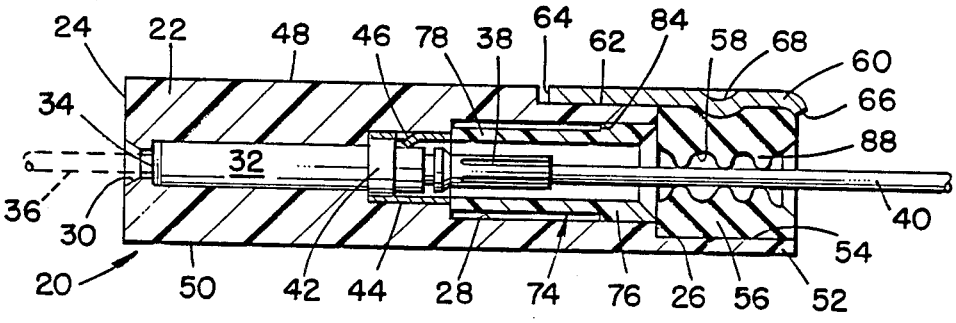
FIG. 7 is a cross section view of the connector, similar to FIG. 6, but illustrating the contact in its final position, ready for use.

The connector assembly 20 also includes a plurality of elongated hollow contacts 32, each being received in an associated bore 28. Each contact 32 has a first end 34 which is a hollow pin receiving member adapted to engageably receive a mating pin 36 (see FIG. 7) of a mating connector to which the connector assembly 20 is to be joined. As seen in FIG. 7, the mating pin 36 extends through the associated entry aperture 30 formed in the front wall 24. A second, opposite, end of the contact 32 may be a wire receiving barrel 38 adapted to receive an associated wire lead 40. In this instance, the barrel would be subject to a crimping operation for engagement with the wire lead 40. Of course, it will be appreciated that the second end 38 may be designed in some other fashion for attachment with the wire lead 40. Each contact 32 is also provided with an annular rim 42 intermediate the ends 34 and 38 for purposes which will be subsequently described.

A hollow cylindrical retainer member 44 is a suitably formed metallic part which is received within each of the bores 28 and generally encircles the contact 32. The retainer member 44 is captured and held in position in the bore 28 in which it is received and held against removal from the housing 22 by structure which will be described. Each retainer member 44 has a radially extending spring member 46 which is angled to permit entry of the contact 32 until its first end 34 is adjacent the entry aperture 30 (FIG. 7), but which thereafter engages the annular rim 42 to prevent withdrawal of the contact member 32 from the housing 22.

Figure 6:
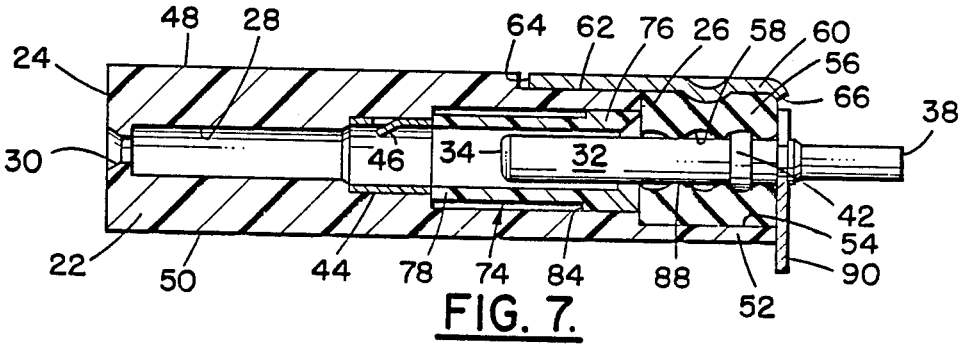
FIG. 6 is a cross section view illustrating a connector of the invention with a contact in an intermediate position awaiting a crimping operation.
Figure 8:
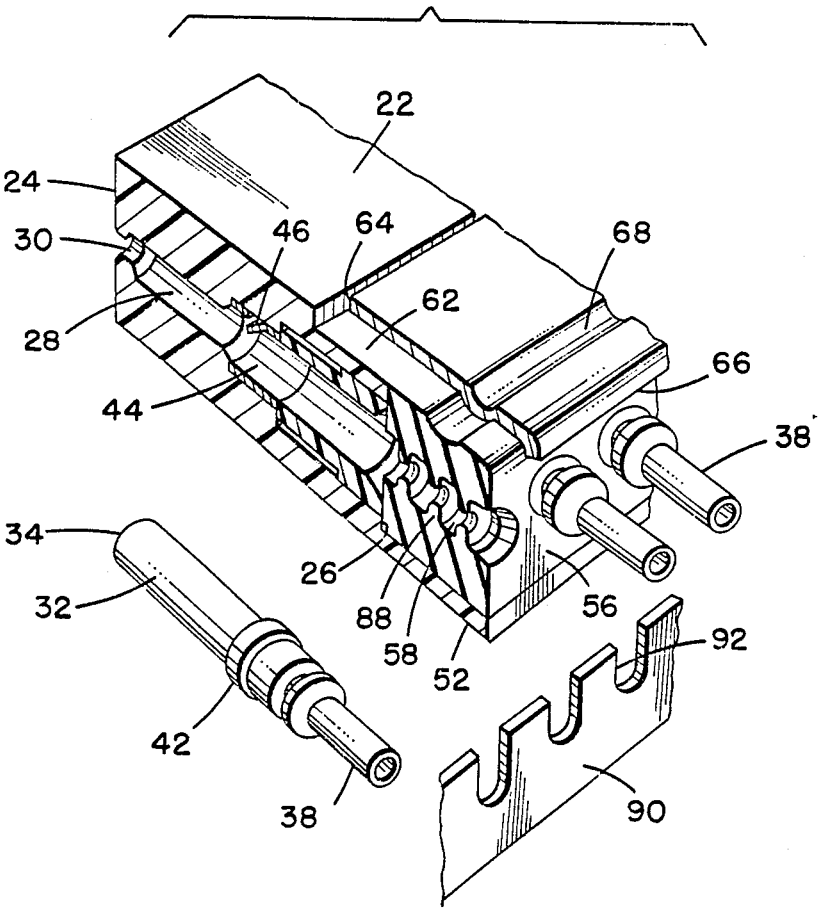
FIG. 8 is a detail, partially exploded, perspective view illustrating a portion of the connector of the invention, certain parts being cut away and shown in section.

As seen particularly well in FIGS. 6–8, the housing 22 defines an upper portion 48, a lower portion 50, and an elongated shelf member 52 which extends along and outwardly from the rear wall 26 at the lower portion 50. In turn, the shelf member 52 defines an upper surface 54.

A resilient elongated grommet 56 of suitable material such as silicone rubber is positioned on the upper surface 54 of the shelf member 52. The grommet 56 is formed with a plurality of side-by-side openings 58 therethrough, aligned with the bores 28 in the housing 22 so as to receive the wire leads 40 therethrough (FIG. 7).

A latch plate 60 overlies and extends along the upper portion 48 of the housing 22, perhaps on a recessed surface 62 as seen in FIGS. 3, and 6–8. As seen particularly well in FIGS. 6–8, the latch plate 60 extends outwardly from the aft end or rear wall 26. It has a leading edge 64 generally co-extensive with the upper portion 48. The latch plate 60 extends across and in engagement with grommet 56 to a trailing edge 66 distant from the leading edge 64. The trailing edge 66 turns downwardly toward the shelf member 52. This serves to restrain movement of the resilient grommet in a direction away from the rear wall 26. The latch plate 60 may be provided with depressed regions 68 to assure a firm engagement of the grommet 56 by latch plate 60. Suitable fasteners such as rivets 70 (FIG. 3) received through holes 72 in the latch plate 60 and mating holes 73 in the housing 22 serve to secure the latch plate 60 to the housing 22 and, with it, the grommet 56 and the other internal components of the connector assembly 20.

Also, received within each bore 28 of the housing 22 is a dielectric spacer 74 of suitable material such as thermoplastic polyester. The spacer 74, as particularly well seen in FIGS. 6–8, is positioned intermediate the retainer member 44 and the grommet 56 and encircles each of the contacts 32. The spacer 74 is formed of a block member 76 (FIG. 3) having front and rear faces, 80 and 82, respectively. The block member 76 is received in a similarly shaped rear recess 84 which extends the entire length of the housing 22 and each of the insert members 78 is received in an associated bore 28. The spacer 74 has a plurality of passageways, each extending through an associated insert member 78 and through the block member 76, all the way to the rear face 82 of the block member. When the block member 76 is fully received in the rear recess 84, the extremities of the insert members 78 distant from the block member 76 are positioned adjacent to, and engage, their associated retainer members 44. The latch plate 60 with its down turned trailing edge 66 engaging the grommet 56 thus also retains the dielectric spacer 74 and the retainer members 44 in position as previously described.

As seen especially in FIGS. 6–8, the grommet 56 has, within each of the side-by-side openings 58, a plurality of longitudinally spaced annular lips 88. Each lip defines an orifice having a cross sectional area less than the remainder of the opening. In this fashion, turning to FIG. 6, the contacts 32 can be held in an intermediate position properly aligned with the housing 22 but not yet in the final positions depicted in FIG. 7. In this intermediate position, the contacts are properly positioned for a crimping operation which forms no part of the present invention. However, it is important to note that the grommet 56 is sufficiently expandable to allow longitudinal passage therethrough of the contact 32 while being sufficiently firm to hold the contact steady during the crimping operation. As seen in FIG. 6, the annular rim 42 of the contact 32 is positioned in a valley between neighboring annular lips 88.

During the crimping operation, an appropriately shaped support bar 90 may be utilized to engage the individual contacts 32 by means of U-shaped slots 92 to aid in supporting and locating the contacts as an indenting mechanism (not shown), performs the crimping operation to attach wire leads 40 to the wire receiving barrels 38. While the crimping operation is in progress, the annular lips 88 bear tightly against the contacts 32 to prevent the entry of debris or moisture into the interior of the connector assembly 20.

Upon completion of the crimping operation, the contacts 32 are moved in any suitable fashion to their final positions as depicted in FIG. 7. When this occurs, once again, the lips 88 within each opening 58 of the grommet 56 bear firmly against the wire lead 40 and continue to prevent the entry of debris or moisture into the interior of the connector assembly 20.

While a preferred embodiment of the invention has been disclosed in detail, it should be understood by those skilled in the art that various modifications may be made to the illustrated embodiment without departing from the scope as described in the specification and defined in the appended claims.

What is claimed is:

1. A connector assembly comprising:

a housing including a front wall and an aft end and having a plurality of side by side mutually isolated bores formed therein extending between said aft end and said front wall and terminating at an entry aperture in said front wall;

a plurality of elongated contacts, each of said contacts including a first end positioned adjacent the entry aperture in said front wall and a second end adapted to be attached to an associated wire lead;

retainer means fixed to said housing engageable with each of said contacts to prevent withdrawal thereof from its associated bore;

seal means mounted on said aft end of said housing for sealingly engaging the wire leads;

dielectric spacer means intermediate said retainer means and said seal means encircling each of said contacts and having a terminal end nearer said aft end of said housing than said second end of each of said contacts to thereby assure high surface resistivity between said contacts positioned in adjacent bores; and latch means for integrally joining said housing, said seal means and said contacts.

2. A connector assembly as set forth in claim 1 wherein said first end of each of said contacts is a hollow pin receiving end adapted to engageably receive a mating pin extending through the associated entry aperture in said front wall;

wherein said second end of said contacts is a wire receiving barrel opposite said first end adapted to receive an associated wire lead and subject to a crimping operation for engagement with the wire lead; and wherein each of said contacts includes an annular rim intermediate said first and second ends, said retainer means being engageable with said rim to thereby prevent withdrawal of said contact from its associated bore.

3. A connector assembly as set forth in claim 1 wherein said latch means includes:

a latch plate engageable with said housing and with said seal means; and fastener means for securing said latch plate to said housing.

4. A connector assembly as set forth in claim 1 wherein said housing includes:

an upper portion;

a lower portion;

a rear wall opposite said front wall; and an elongated shelf member extending along and outwardly from said rear wall at said lower portion and defining an upper surface;

wherein said seal means includes:

a resilient elongated grommet having a plurality of side-by-side openings therethrough aligned with the bores in said housing so as to receive the wire leads therethrough, said seal means being positioned on said upper surface of said shelf member; and wherein said latch means includes:

a latch plate overlying and extending along said upper portion of said housing and extending outwardly from said rear wall, said latch plate having a leading edge coextensive with said upper portion and extends across and in engagement with said grommet to a trailing edge distant from said leading edge and turned downwardly toward said shelf member to restrain movement of said resilient grommet in a direction away from said rear wall; and fastener means for securing said latch plate to said housing.

5. A connector assembly as set forth in claim 1 wherein said housing has a recess at its aft end communicating with each of the bores therein; and wherein said spacer means includes:

a block member received in the recess and having front and rear faces; and a plurality of cylindrical insert members projecting away from said front face, each of said insert members received in an associated one of the bores in said housing;

said spacer means having a plurality of passageways therethrough, each of said insert members having a passageway extending therethrough and through said block member to and communicating with said rear face of said block member.

6. A connector assembly as set forth in claim 1 wherein said first end of each of said contacts is a hollow pin receiving member adapted to engageably receive a mating pin extending through the associated entry aperture in said front wall.

7. A connector assembly as set forth in claim 6 wherein said second end of each of said contacts is a wire receiving barrel opposite said first end adapted to receive an associated wire lead and subject to a crimping operation for attachment to the wire lead.

8. A connector assembly as set forth in claim 1 wherein each of said contacts includes an annular rim intermediate said first and second ends, said retainer means being engageable with said rim to thereby prevent withdrawal of said contact from its associated bore.

9. A connector assembly as set forth in claim 8 wherein said retainer means includes a retainer member positioned within each of the bores having a radially extending spring member engageable with said annular rim.

10. A connector assembly as set forth in claim 8 wherein said retainer means includes a hollow cylindrical retainer member positioned within each of the bores and generally encircling said contact, said retainer member having a radially extending spring member engageable with said annular rim.

11. A connector assembly as set forth in claim 1 wherein said seal means includes a resilient grommet having a plurality of side-by-side openings therethrough aligned with the bores in said housing so as to sealingly receive the wire leads therethrough.

12. A connector assembly as set forth in claim 11 wherein said second end of each of said contacts is a wire receiving barrel opposite said first end adapted to receive an associated wire lead; and wherein during assembly of the connector assembly in which said contacts are moved longitudinally through associated bores from said aft end toward said front wall, said resilient grommet is sufficiently expandable to allow longitudinal passage therethrough of said contacts while being sufficiently firm to hold said contacts steady during a crimping operation for firmly attaching the wire leads to said second end and being sufficiently retractable to sealingly engage the wire leads as said first ends of said contacts approach and reach said front wall.

13. A modular plug comprising:

a housing including a front wall and an aft end and having a plurality of side-by-side mutually isolated bores formed therein extending between said aft end and said front wall and terminating at a pin entry aperture in said front wall;

a plurality of elongated socket contacts, each of said contacts being receivable from said aft end in an associated bore, each of said contacts including a hollow pin receiving end positioned adjacent the aperture in said front wall, a wire receiving barrel at its opposite end being subject to a crimping operation for engagement with an associated wire lead, and an annular rim intermediate said pin receiving end and said wire receiving barrel;

a retainer fixed to said housing within the bore and having a radially extending spring member engageable with said contact enabling longitudinal movement of said contact into the bore from said aft end but engageable with said annular rim when said pin receiving end is positioned proximate to the aperture in said front wall to thereafter prevent withdrawal of said contact from the bore;

a resilient grommet seal mounted on said aft end of said housing having a plurality of side-by-side openings therethrough aligned with the bores in said housing, said grommet seal being sufficiently expandible to allow longitudinal passage therethrough of said contacts while being sufficiently firm to hold said contacts steady during the crimping operation and being sufficiently retractable to sealingly engage the wire ends as said pin receiving end of said contacts approach and reach said front wall;

dielectric spacer means intermediate said retainer means and said seal means encircling each of said contacts and having a terminal end nearer said aft end of said housing than said second end of each of said contacts to thereby assure high surface resistivity between said contacts positioned in adjacent bores;

a latch plate engageable with said housing and with said grommet seal for integrally joining said housing, said grommet seal and said contacts; and fastener means for securing said latch plate to said housing.

14. A connector assembly as set forth in claim 13 wherein said housing includes:

an upper portion;

a lower portion;

a rear wall opposite said front wall; and an elongated shelf member extending along and outwardly from said rear wall at said lower portion and defining an upper surface;

wherein said seal means includes:

a resilient elongated grommet having a plurality of side-by-side openings therethrough aligned with the bores in said housing so as to receive the wire leads therethrough, said seal means being positioned on said upper surface of said shelf member; and wherein said latch means includes a latch plate overlying and extending along said upper portion of said housing and extending outwardly from said rear wall, said latch plate having a leading edge coextensive with said upper portion and a trailing edge distant therefrom and turned downwardly toward said shelf member to restrain movement of said resilient grommet in a direction away from said rear wall; and fastener means for securing said latch plate to said housing.

15. A connector assembly as set forth in claim 14 wherein said housing has a recess at its aft end communicating with each of the bores therein; and wherein said spacer means includes a block member received in the recess and having front and rear faces, and a plurality of cylindrical insert members projecting away from said front face, each of said insert members received in an associated one of the bores in said housing;

said spacer means having a plurality of passageways therethrough, each of said insert member having a passageway extending therethrough and through said block member to and communicating with said rear face of said block member.

16. A connector assembly as set forth in claim 15 wherein said grommet has a plurality of longitudinally spaced annular lips within each of the side-by-side openings, each lip defining an orifice having a cross sectional area less than the remainder of the opening.

* * * * *